US006099342A

United States Patent [19]

Letourneau

[11] Patent Number: 6,099,342

[45] Date of Patent: Aug. 8, 2000

[54] LATCH KEY MECHANISM

[75] Inventor: Guy Louis Letourneau, Warren, Oreg.

[73] Assignee: The Whitaker Corporation, Wilmington, Del.

[21] Appl. No.: 09/089,889

[22] Filed: Jun. 4, 1998

[51] Int. Cl.[7] ..... H01R 13/629

[52] U.S. Cl. ..... 439/372

[58] Field of Search ..... 439/372, 261, 439/352, 259, 262, 310, 364

[56] References Cited

U.S. PATENT DOCUMENTS 5,368,496 11/1994 Ranalletta et al. ..... 439/261

5,630,419 5/1997 Ranalletta ..... 128/662.03

*Primary Examiner*—Steven L. Stephan

*Assistant Examiner*—Eugene Byrd

[57] ABSTRACT

A latch key mechanism 1 has a rotatable latch key 2, a holder 7 rotatably receiving the latch key 2, a spring 16 connected to the latch key 2 and to the holder 7, the spring 16 biasing the latch key 2 to rotate in a first direction to a desired position aligned with the profile of a keyhole 3 through which the latch key 2 is to be inserted, and the latch key 2 being rotatable against a resilient bias of the spring 16 to a latching position beyond the keyhole 3.

15 Claims, 10 Drawing Sheets

Fig. 7
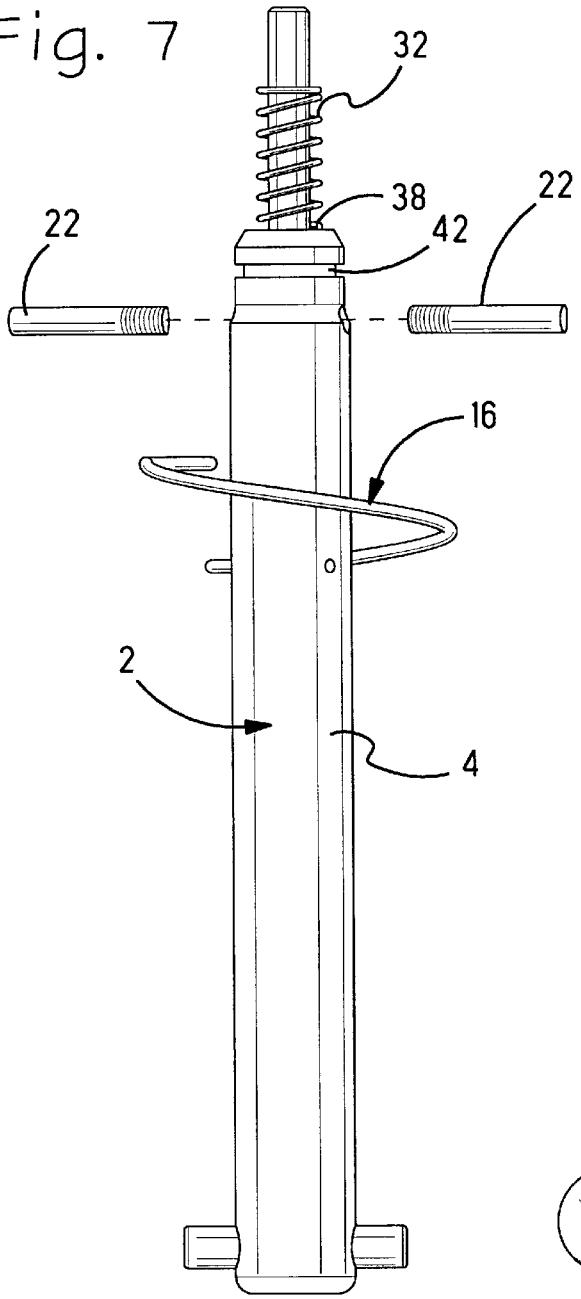
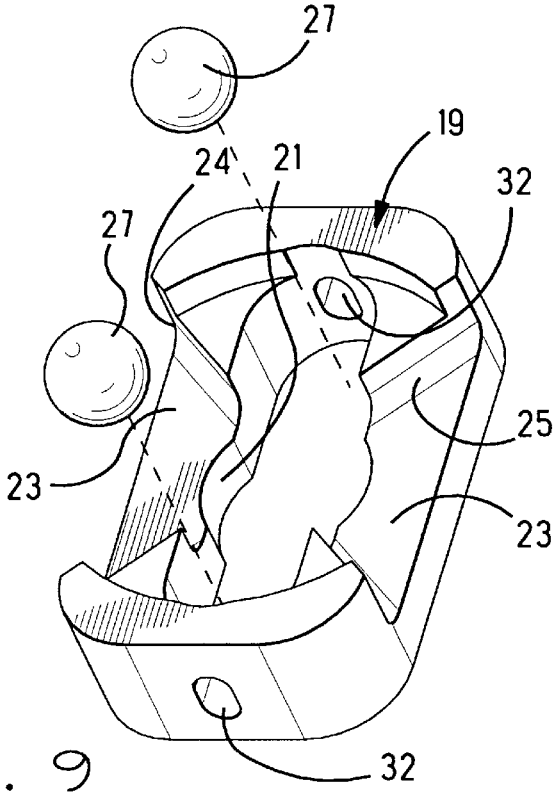
Fig. 9

LATCH KEY MECHANISM

FIELD OF THE INVENTION

The invention relates to a latch key mechanism having a rotatable latch key, wherein a profile of the latch key is to be aligned with the profile of a keyhole through which the latch key is to be inserted.

BACKGROUND OF THE INVENTION

A known latch key mechanism is used on an electrical connector on a cable assembly, for example, as described in U.S. Pat. No. 5,630,419. A latch key of the known latch key mechanism is inserted through a keyhole, and thereafter is rotated to a latched position beyond the keyhole. When the electrical connector is positioned to establish a mating connection, the latch key assumes a random position, which position often causes misalignment of the latch key with the profile of the keyhole. Manual maneuvering of the latch key mechanism is required to align the latch key with he profile of the keyhole. The profile of the latch key is hidden from view behind the known cable assembly, adding further difficulty to the task of maneuvering she profile in alignment with that of the keyhole. While being hidden from view, the latch key mechanism lacks tactile feel to assist in maneuvering its profile.

SUMMARY OF THE INVENTION

The invention overcomes the need for manual maneuvering of a latch key mechanism on a cable assembly to align the latch key with the profile of a keyhole into which the latch key is to be inserted.

According to the invention, a latch key mechanism has a latch key to be inserted into a keyhole, the latch key is biased to a desired position, which aligns the latch key with a projection of an image of the keyhole onto the latch key mechanism.

It is advantageous to bias the latch key to a desired position that is in alignment with a projection of an image of the keyhole onto the latch key mechanism. Even though hidden from view, the latch key in its desired position would be in desired alignment for insertion into the keyhole without having to manually maneuver the latch key from a random position.

It is further advantageous that the latch key mechanism is adapted to be retained by a connector of a cable assembly in alignment with a projected image of a keyhole, to enable the cable assembly to align the latch key with the keyhole into which the latch key is to be inserted.

An embodiment of the invention will now be described by way of example, with reference to the accompanying drawings, according to which:

FIG. 7 is a side view of a shaft shown with springs and portions of a draw bar separated from the shaft;

FIG. 9 is a view similar to FIG. 8 of the thrust bearing together with spherical rollers;

DETAILED DESCRIPTION

Figure 1:
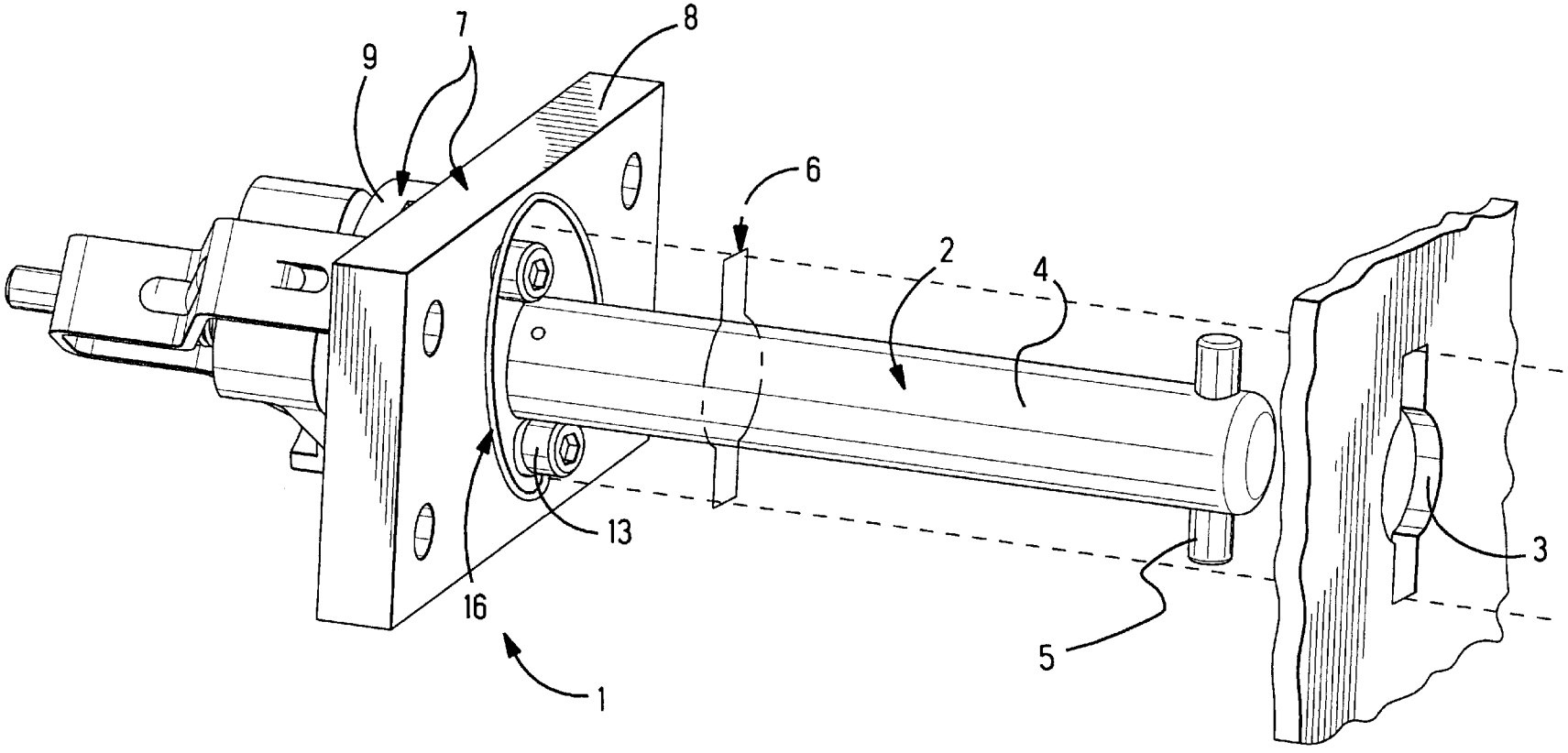
FIG. 1 is an enlarged isometric view of a latch key mechanism with parts separated from one another.

With reference to FIG. 1, a latch key mechanism comprises a rotatable latch key 2 having a profile for alignment with a keyhole 3 into which the latch key 2 is to be inserted. The latch key 2 has an elongated cylindrical shaft 4. The shaft 4 is intersected by a transverse pin 5, which provides the profile. The latch key 2 is to be inserted into the keyhole 3 until the transverse pin 5 is beyond the keyhole 3. Thereafter rotation of the latch key 2 by manual operation turns the profile of the latch key 2, to a latched position beyond the keyhole 3.

For example, the latch key mechanism 1 is combined with a known electrical connector on a cable assembly, for example, as described in U.S. Pat. No. 5,630,419, wherein the known electrical connector has a previously known latch key mechanism that is inserted through a keyhole, and thereafter is rotated to a latched position beyond the keyhole. The latch key mechanism on the known electrical connector has been known to assume a position that is out of alignment with the keyhole. Manual maneuvering of the latch key mechanism is required to align the latch key with the keyhole. The lack of tactile feel adds further difficulty to the task of aligning the latch key with the keyhole. There is a need to helically advance the latch key to a latched position beyond the keyhole. The known latch key mechanism lacks an assist to the helical advancement of the latch key mechanism to said latched position.

The desired position of the latch key 2 is obtained by a projection of an imaginary image 6, FIG. 1, of the profile of the keyhole 3 upon a surface of a holder 7 that faces the keyhole 3. The desired position is that to which the profile of the latch key 2 is rotated to align with the projection of the image 6 of the profile of the keyhole 3. Once the holder 7 is mounted to a known connector of a known cable assembly, for example, as known from U.S. Pat. No. 5,630,419, the profile of the latch key 2 is retained by the connector of the cable assembly in alignment with the projected image 6 of a keyhole 3, which enables the cable assembly to align the latch key 2 with the keyhole 3 into which the latch key 2 is to be inserted without a need to manually maneuver the latch key 2.

Figure 18:
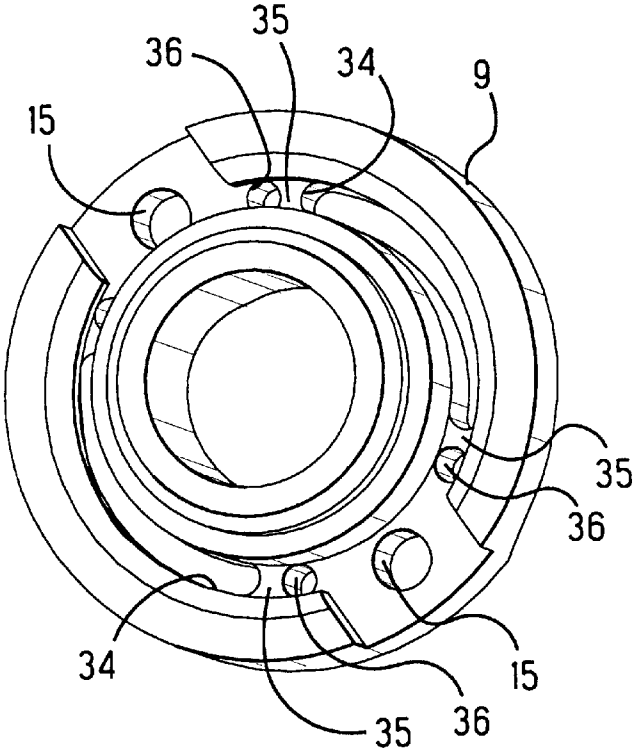
FIG. 18 is an isometric view of a bottom of the hub as shown in FIG. 17.

With reference to FIG. 1, further details of the latch key mechanism 1 will be described. A holder 7 rotatably receives the latch key 2. For example, the holder 7 comprises, a transverse plate 8 and a hub 9, having respective bores 10, 11 through which the latch key 2 projects. The hub 9 registers in a counterbore 12 in the plate 8. The hub 9 and the plate 8 are secured together by machine screws 13 having enlarged heads. The machine screws 13 extend through corresponding bores 14 through the plate 8, and threadably secure in tapped threaded recesses 15, FIG. 18, in the hub 9. The plate 8 has an elongated shape to fit in a known, elongated electrical connector, for example, a known electrical connector as described in U.S. Pat. No. 5,630,419. A spring 16 is connected to the latch key 2 and to the holder 7.

Figure 2:
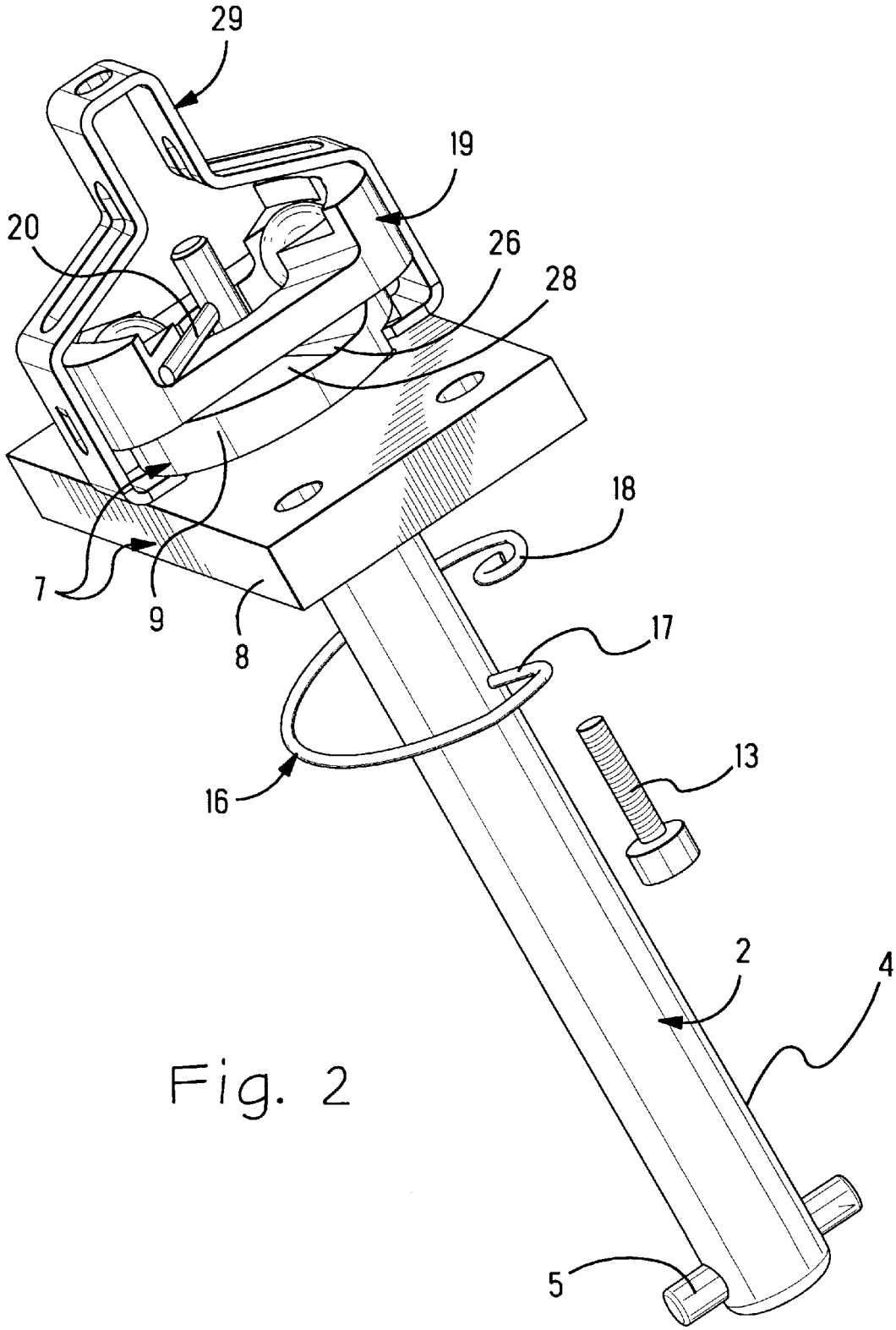
FIG. 2 is a view similar to FIG. 1 of the latch key mechanism.
Figure 3:
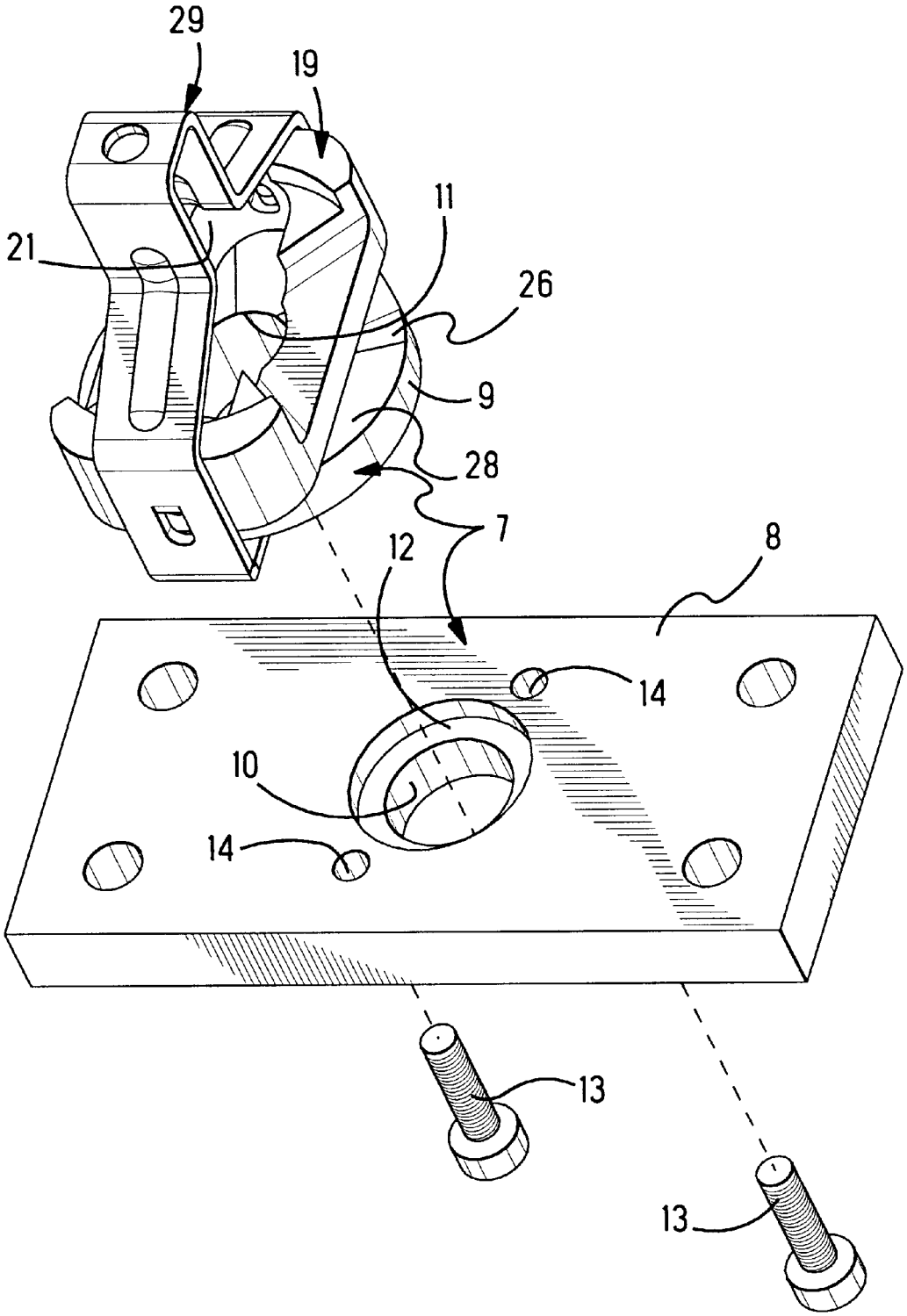
FIG. 3 is an isometric view of a portion of the latch key mechanism as shown in FIG. 1 with parts separated from one another.
Figure 4:
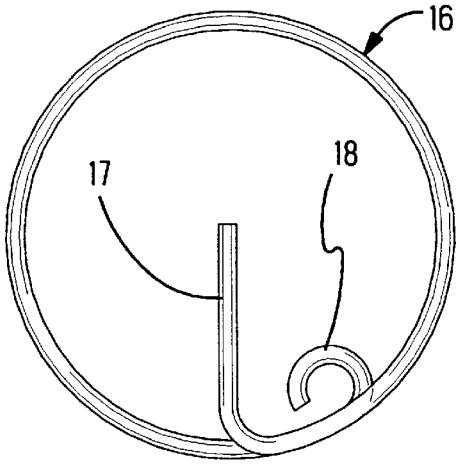
FIG. 4 is a bottom view of a spring.
Figure 6:
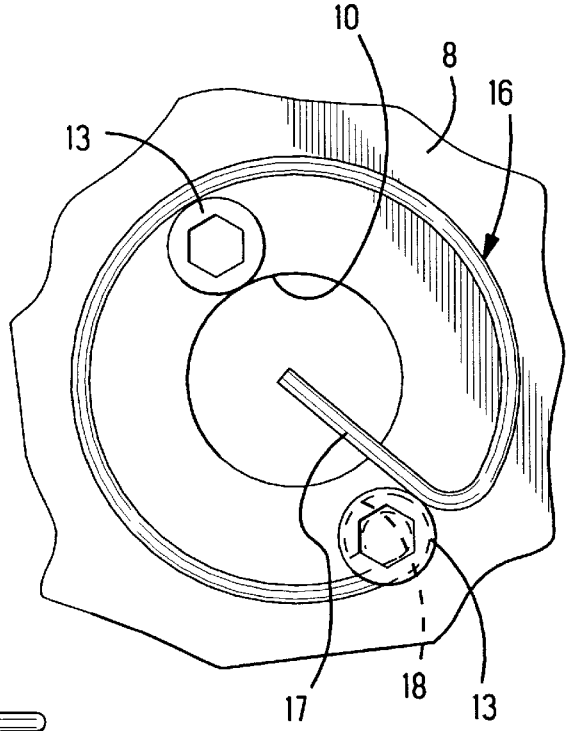
FIG. 6 is a view similar to FIG. 4 of the spring together with mounting screws securing the spring to a broken away portion of a plate.
Figure 5:
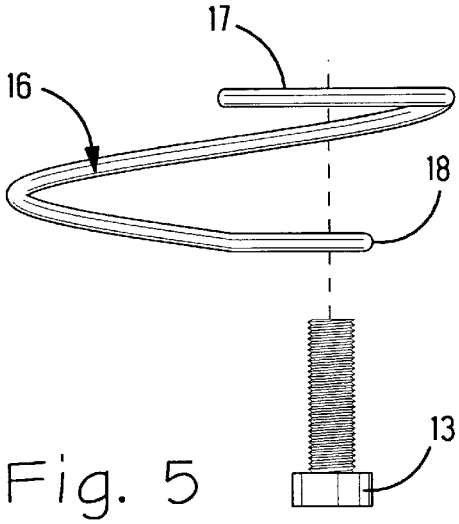
FIG. 5 is a side view of the spring as shown in FIG. 4 together with a mounting screw.

With reference to FIGS. 4–6, the spring 16 will now be described. The spring 16 has a helical coil contiguous with a straight end 17 and a curled end 18. The curled end 18 connects to the holder 7 by surrounding a shaft of one of the machine screws 13. As shown in FIGS. 2 and 7, the straight end 17 is secured to the shaft 4 of the latch key 2, for example, by fitting in a small bore in the shaft 4. The helical coil of the spring 16 is resiliently flattened to project the shaft 4 of the latch key 2 through the plate 8 and through the hub 9 of the holder 7. The flattened helical coil of the spring lo tends to expand resiliently and apply longitudinal thrust upon the latch key 2.

As shown in FIG. 6, a portion of the spring 16 adjacent to the straight end 17 impinges an enlarged head of the corresponding machine screw 13. Upon rotation of the shaft 4 of the latch key 2, for example, clockwise, the coil of the impinged spring 16 will be caused to enlarge, and increase its resilient bias. The spring 16 biases the latch key 2 to rotate in a first direction, for example, counterclockwise, or anticlockwise, to a desired position relative to the holder 7, where its profile is aligned with the projected image 6 of the keyhole 3. Residual bias provided by the spring 16 tends to retain the latch key 2 in its desired position, unless the latch key mechanism 1 is rotated by manual operation.

The latch key mechanism 1 of the invention is biased to a desired position, which aligns the profile of the latch key 2 with the projection of the image 6 of the profile of a keyhole 3 through which the latch key 2 is to be inserted. Following insertion of the latch key 2 through the keyhole 3, the latch key 2 is rotatable against a resilient bias provided by the spring 16 to rotate the latch key 2 in a second direction, for example, clockwise, to a known latching position beyond the keyhole 3.

Figure 8:
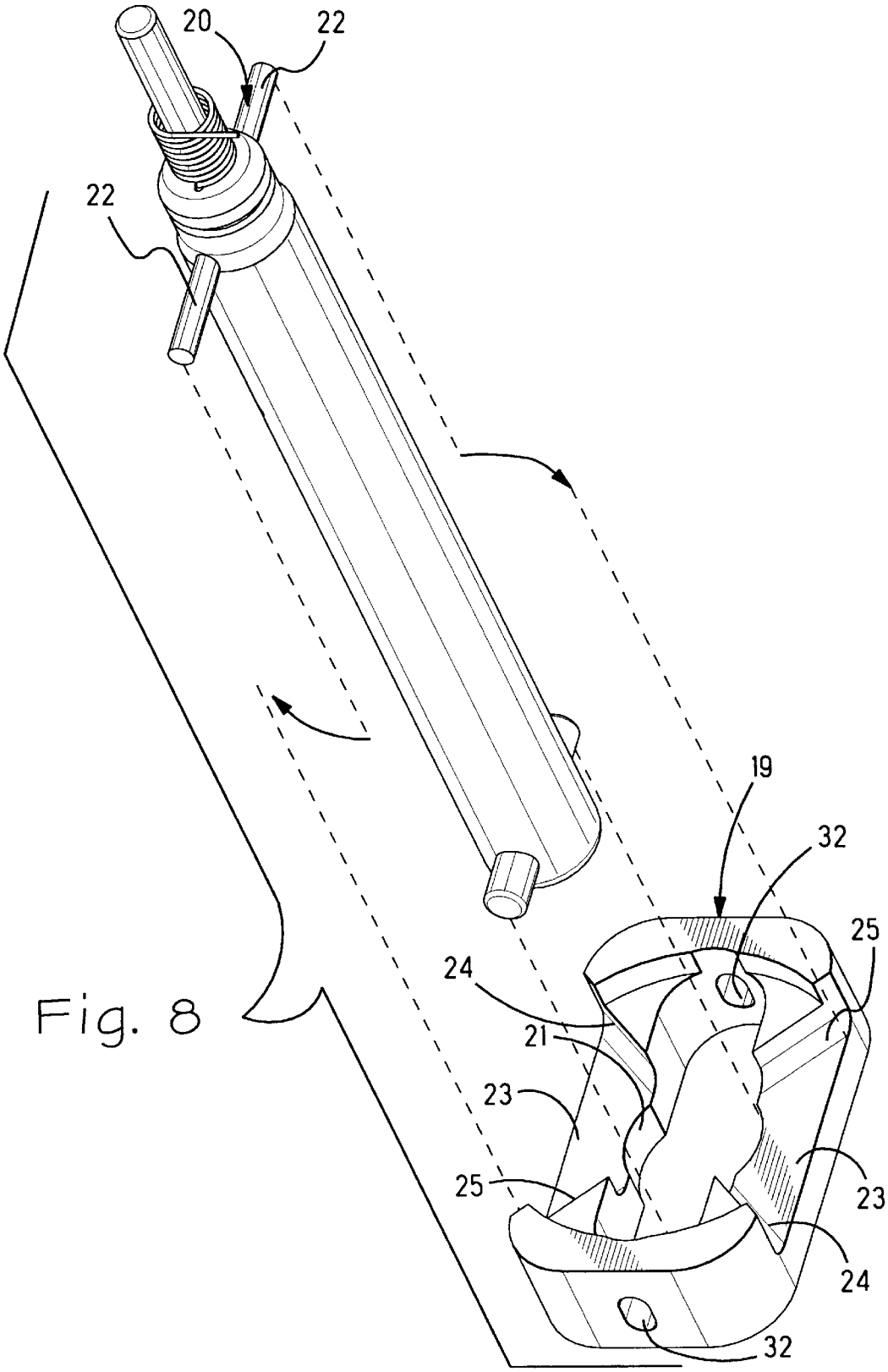
FIG. 8 is an isometric view of a thrust bearing together with a portion of the shaft as shown in FIG. 7.
Figure 10:
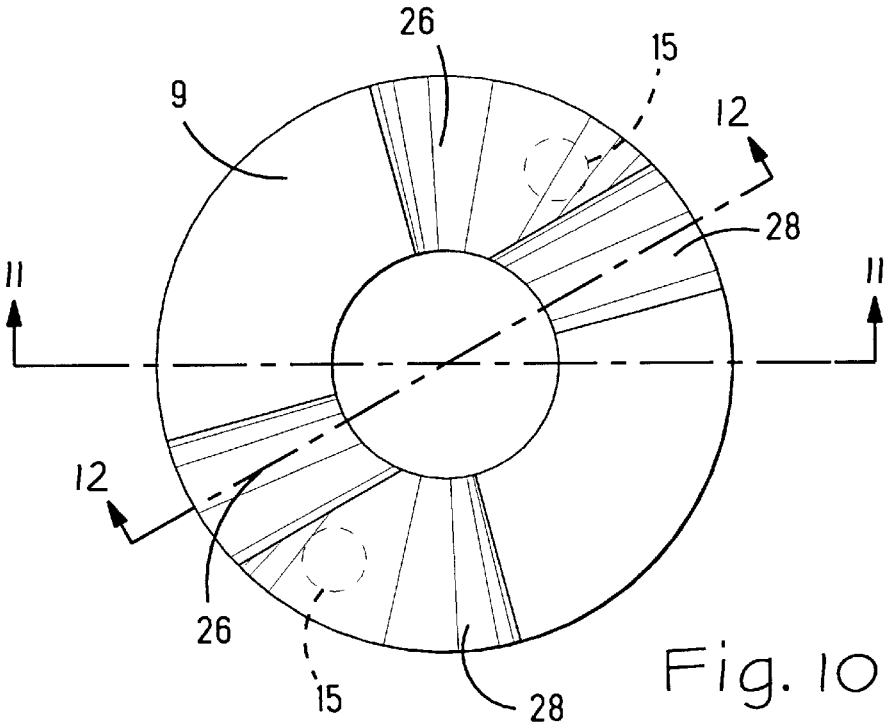
FIG. 10 is a top view of a hub having cam surfaces along helical paths.
Figure 11:
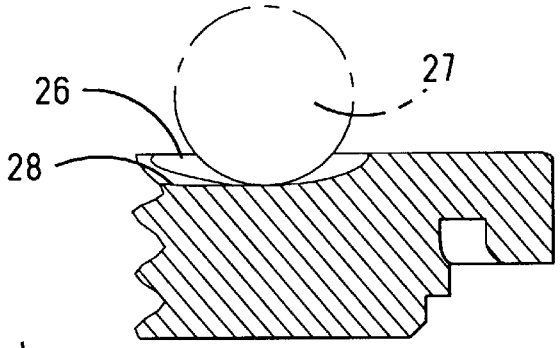
FIG. 11 is a section view taken along the line 11—11 of FIG. 10.
Figure 12:
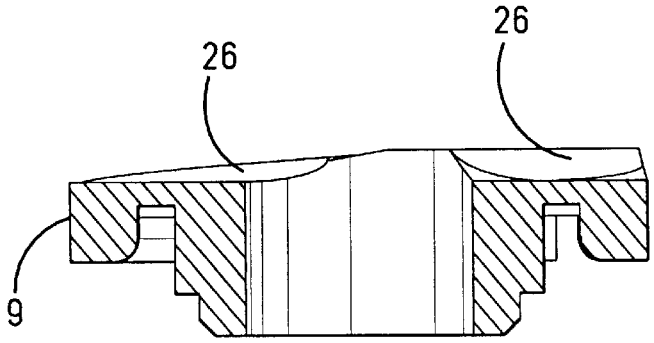
FIG. 12 is a section view taken along the line 12—12 of FIG. 10.
Figure 16:
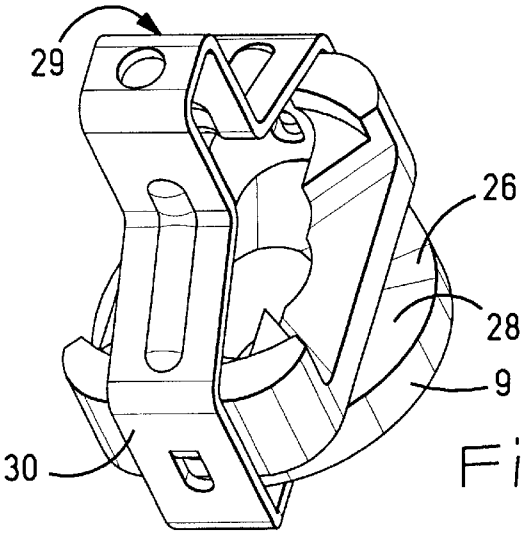
FIG. 16 is an isometric view of the structure as shown in FIG. 14.
Figure 15:
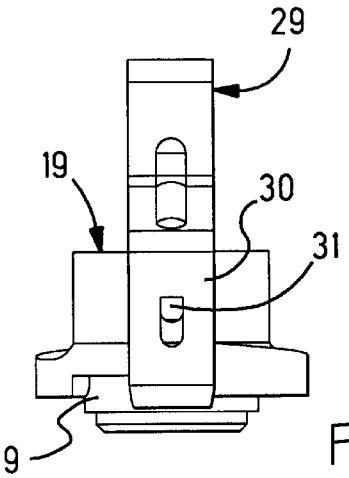
FIG. 15 is a side view of the structure as shown in FIG. 14.
Figure 13:
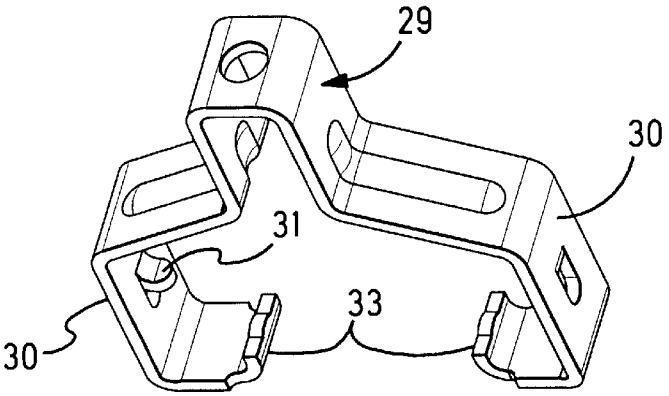
FIG. 13 is an isometric view of a handle portion.
Figure 14:
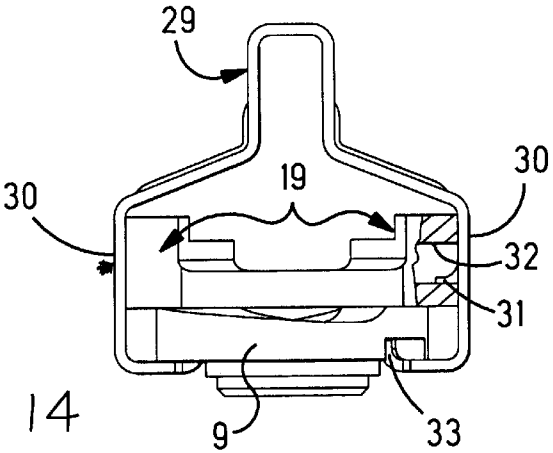
FIG. 14 is a side view of the handle portion as shown in FIG. 13 assembled to a hub and a thrust bearing, as shown in FIGS. 10 and 8, respectively.

With reference to FIGS. 2 and 7–9 a thrust bearing 19 is connected to the latch key 2 by a draw bar 20. The shaft 4 of the latch key 2 projects through an opening 21 through the thrust bearing 19. The transverse draw bar 20, for example, is constructed of threaded pins 22, FIG. 7, secured in tapped recesses in the shaft 4. As shown in FIG. 8, the draw bar 20 is situated to extend transversely across the opening 21 in the thrust bearing 19 to overlap respective flat surfaces 23 adjacent to the opening 21. Each of the flat surfaces 23 is between a pair of radially extending side walls 24, 25 spaced 120 degrees apart.

Upon rotation of the thrust bearing in the second direction, the thrust bearing 19 undergoes relative rotation within 120 degrees of rotation relative to the latch key 2. Further rotation of the thrust bearing 19 beyond the 120 degrees of rotation will move corresponding walls 25 on the thrust bearing 19 into engagement with the draw bar 20, urging the draw bar 20 to rotate together with the thrust bearing 19. Such further rotation of the thrust bearing 19 occurs in the second direction, and causes the draw bar 20 to urge the latch key 2 to rotate in the second direction together with the thrust bearing 19.

The thrust provided by the flattened coil of the spring 16 urges the draw bar 20 to apply thrust to the flat surfaces 23 on the thrust bearing 19. In turn, the draw bar 20 urges the thrust bearing 19 toward the hub 9 of the holder 7.

The hub 9 will now be described with reference to FIGS. 2 and 10–12. A helical path extends along a sloped cam surface 26 on the hub 9 of the holder 7. The helical path extends generally around the shaft 4 on the latch key 2. Upon rotation of the latch key 2 and the thrust bearing 19, relative to the holder 7, the thrust bearing 19 traverses along the helical path on the hub 9 of the holder 7 to helically advance the latch key 2 of the latch key 2 to said latching position beyond the keyhole 3. The helical advance of the latch key 2 advantageously assists the latch key 2 to threadably advance to the latching position, for example, when the latch key 2 must follow machined, tapped threads beyond the keynote 3.

For example, the thrust bearing 19 has spherical rollers 27, FIG. 9, captured within closed ends of the elongated opening 21. The rollers 27 are urged along he helical path to reduce frictional resistance to the traverse of the thrust bearing 19 along the helical path. Flat ends 28 of the helical paths are free of slope to provide detents for the rollers 27. The helical paths, including the flat ends 28, are concave to center the spherical surfaces of the rollers 27 on the helical path.

With reference to FIGS. 13–16, a handle portion 29 of the latch key mechanism 1 is a formed metal strap in the shape of a yoke. The handle portion 29 has arms 30 that straddle and slidably connect to the thrust bearing 19. Inward projecting tabs 31 on the arms 30 are slidable in elongated recesses 32, FIG. 9, in the thrust bearing 19 as the thrust bearing 19 raises and lowers as it follows the raised cam surface 26 on the hub 9 of the holder 7. The handle portion 29 and the thrust bearing 19 rotate together.

Figure 17:
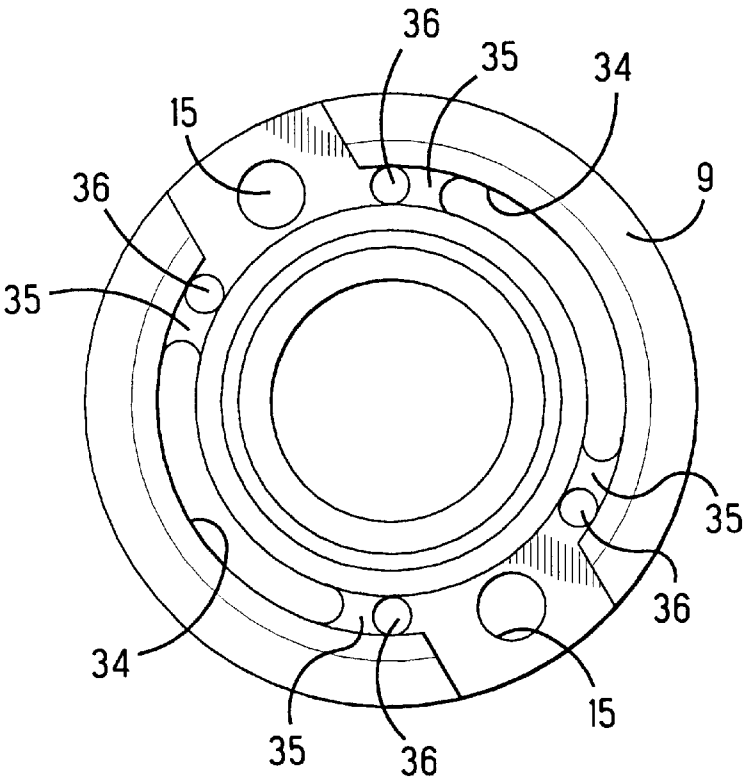
FIG. 17 is a bottom view of the hub as shown in FIG. 10.

With further reference to FIGS. 13–16, the arms 30 straddle the hub 9. The arms 30 have tips 33 that are turned under the hub 9 to register in respective arcuate tracks 34, FIGS. 17 and 18, in the hub 9. The arms 30 follow along the arcuate tracks 34 upon rotation of the handle portion 29. The tracks 34 are formed, for example, by arcuate slots through the hub 9. Ends of the slots form ends of the tracks 34. At corresponding ends of the tracks 34, are recessed webs providing friction surfaces 35 and more deeply recessed detents 36 in the holder 7. The friction surfaces 35 are followed in seriatim by the detents 36. Upon rotation of the handle portion 29, the arms 30 traverse along the respective arcuate tracks 34, and frictionally traverse over the friction surfaces 35 to provide a tactile feel prior to registration of the arms 30 in respective detents 36.

Figure 19:
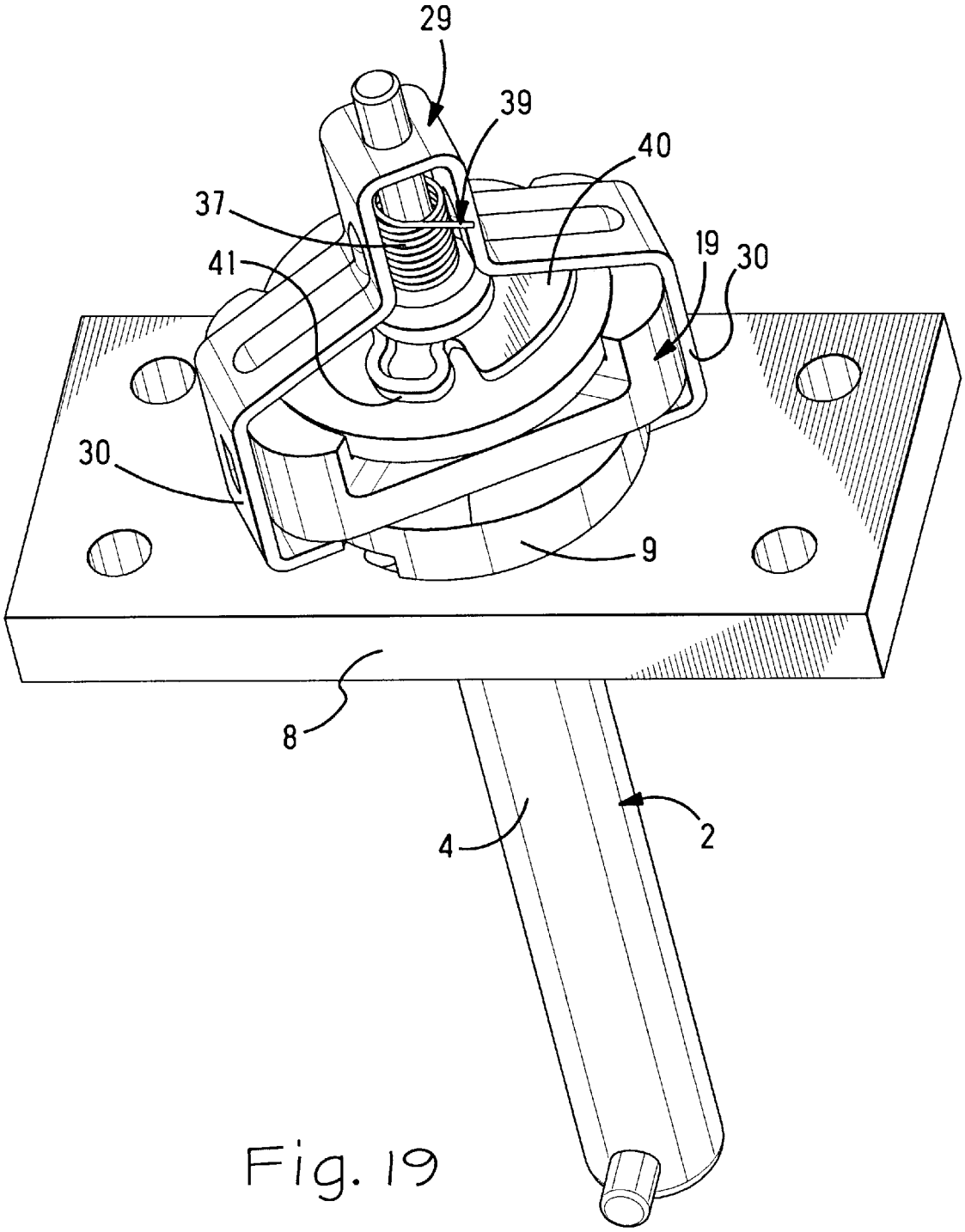
FIG. 19 is an isometric view of the latch key mechanism as shown in FIG. 1 having a second spring connected to the handle portion as shown in FIG. 13.

With reference to FIGS. 7 and 19, an additional spring 37 is connected to the shaft 4 of the latch key 2 and to the handle portion 29. The additional spring 37 is a coil spring 16 encircling the shaft 4 of the latch key 2. One end 38, FIG. 7, of the additional spring 37 is secured in a recess in the shaft 4. Another end 39, FIG. 19, of the additional spring 37 projects go register against the handle portion 29. The additional spring 37 biases the handle portion 29 to rotate in a first direction relative to the latch key 2 to a first position. Residual bias provided by the spring 16 tends to retain the handle portion 29 in its first position unless the handle is rotated by manual operation.

The handle portion 29 is rotatable, by manual operation, in a second direction against a resilient bias provided by the additional spring 37. Because the additional spring 37 has a weaker spring rate than the stronger spring rate of the spring 16, the handle portion 29 rotates in the second direction, together with the thrust bearing 19, while increasing the bias provided by the additional spring 37, and without being accompanied by rotation of the latch key 2. Rotation of the handle portion 29 occurs for 10 degrees of rotation relative to the latch key 2, to increase the bias provided by the additional spring 37. Rotation of the handle portion 29 continues until the walls 25 on the thrust bearing 19 engage the draw bar 20.

Further rotation of the handle portion 29 in the second direction, with the walls 25 engaged on the draw bar 20, urges the draw bar 20 to rotate the latch key 2 together with the handle portion 29, and together with the thrust bearing 19. Rotation of the latch key 2 in the second direction opposes the resilient bias provided by the spring 16. Said further rotation of the handle portion 29, accompanied by rotation of the latch key 2, occurs against the combined resilient biases provided by both the spring 16 and the additional spring 37. Such rotation of the latch key 2, accompanied by such further rotation of the handle portion 29, rotates the latch key 2 to said latching position beyond the keyhole 3. Simultaneously, such further rotation of the handle portion 29 causes the rollers 27 on the thrust bearing 19 to detent in the unsloped ends 28 of the helical paths. Simultaneously, such further rotation of the handle portion 29, causes the arms 30 to traverse along the respective arcuate tracks 34, and to frictionally traverse over the friction surfaces 35 to provide a tactile feel prior to registration of the arms 30 in respective detents 36. A tactile feel results from registration of the arms 30 in the detents 36, as a tactile indication that the latch key 2 has attained said latching position beyond the keyhole 3. The handle portion 29 has rotated to its second position. The detents 36 resist further rotation, and latch the latch key 2 in said latching position, unless by manual operation, the handle portion 29 is rotated out of its second position.

To unlatch the latch key 2, the handle portion 29 is rotated by manual operation to rotate in the first direction, overcoming the resistance to rotation provided by the arms 30 in the detents 36. A tactile feel results from the arms 30 disengaging from the detents 36. Rotation of the handle portion 29 in the first direction is assisted by the bias provided by the additional spring 37. Such rotation of the handle, not only dissipates the bias, but also releases the draw bar 20 from engagement by the corresponding walls on the thrust bearing 19. The latch key 2 becomes freed to rotate in the first direction. The draw bar 20 on the latch key 2 is permitted to rotate, while between the spaced apart walls on the thrust bearing 19, for 120 degrees of relative rotation. The same 120 degrees of relative rotation is permitted for rotation of the latch key 2 relative to the thrust bearing 19. In addition, the bias on the additional spring 27 will be sufficient to permit 10 degrees of relative rotation between the latch key 2 and the handle portion 29. This assures that the latch key 2 is freed, so as to rotate its profile to align with a projection of an image 6 of a profile of a keyhole 3 into which the latch key 2 is to be inserted.

Rotation of the handle portion 29 in the first direction is accompanied by traverse of the thrust bearing 19 against the helical path on the sloped cam surface 26. Due to the traverse of the thrust bearing 19, the latch key 2 withdraws from the keyhole 3 along a helical path of withdrawal. Rotation of the latch key 2 in the first direction along a helical path of withdrawal is assisted by the bias provided by the spring 16.

With reference to FIG. 19, the thrust bearing 19 is partially covered by a cap 40 held in place by a snap fastener 41 gripping a stepped circumference 42, FIG. 7, of the shaft 4.

The latch key mechanism 1 is capable of being retained by a connector of a cable assembly for matched alignment with a projection of an image 6 of a profile of a keyhole 3 through which the latch key 2 is to be inserted.

Other embodiments and modifications of the invention are intended to be covered by the spirit and scope of the appended claims.

What is claimed is:

1. A latch key mechanism comprising:

a rotatable latch key having a profile for alignment with a profile of a keyhole into which the latch key is to be inserted and thereafter to be rotated to rotate the latch key to a latched position behind the keyhole, a holder rotatably receiving the latch key, a spring connected to the latch key and to the holder, the spring biasing the latch key for rotation of the latch key relative to the holder to a desired position, at which position the profile of the latch key is aligned relative to a portion of the holder that is known to be aligned with the profile of the keyhole prior to insertion of the latch key into the keyhole, the latch key having been inserted into the keyhole, thereafter being rotatable against a resilient bias of the spring to rotate the profile of the latch key out of alignment with the profile of the keyhole and to rotate the latch key to a latching position behind the keyhole, and upon the latch key having been freed from the latching position prior to withdrawal of the latch key from the keyhole, the spring biasing the latch key to rotate the latch key to said desired position at which position the profile of the latch key is aligned relative to the portion of the holder that is known to be aligned with the profile of the keyhole.

2. A latch key mechanism as recited in claim 1, and further comprising: a cam surface on the holder extending along a helical path encircling the latch key, a thrust bearing connected to the latch key, and upon rotation of the latch key and the thrust bearing relative to the holder, the thrust bearing traversing along the helical path to helically advance the latch key to said latching position.

3. A latch key mechanism as recited in claim 1, and further comprising: the thrust bearing having rollers, the rollers being urged by rotation or the latch key to traverse along the helical path.

4. A latch key mechanism as recited in claim 2, and further comprising: the thrust bearing having rollers, the rollers being urged by rotation of the latch key to traverse along the helical path, and the helical path being concave to conform to the rollers.

5. A latch key mechanism as recited in claim 1, and further comprising: a handle portion rotatable with the latch key, the handle portion having arms registering in respective arcuate tracks in the holder, and the arms following along the tracks upon rotation of the latch key together with the handle portion.

6. A latch key mechanism as recited in claim 1, and further comprising: a handle portion rotatable with the latch key, the handle portion having arms registering in respective arcuate tracks in the holder, friction surfaces at corresponding ends of the tracks, and detents in the holder, and further wherein, upon rotation of the latch key together with the handle portion, the arms traverse along the respective arcuate tracks, and frictionally traverse over the friction surfaces to provide a tactile feel prior to registration of the arms in respective detents.

7. A latch key mechanism as recited in claim 1, and further comprising:

a handle portion, an additional spring connecting the handle portion to the latch key, the additional spring having a relatively weak spring rate, the handle portion being rotatable by manual operation against a resilient bias provided by the additional spring to rotate the handle without being accompanied by rotation of the latch key and second, the handle portion being further rotatable by manual operation to cause further rotation thereof together with rotation of the latch key against the resilient bias of the spring that is connected to the latch key and to the holder, and to rotate the profile of the latch key to said latching position.

8. A latch key mechanism as recited in claim 7, and further comprising: the handle portion having arms registering in respective arcuate tracks in the holder, and the arms following along the tracks upon rotation or the latch key together with the handle portion.

9. A latch key mechanism as recited in claim 7, and further comprising: the handle portion having arms registering in respective arcuate tracks in the holder, friction surfaces at corresponding ends of the tracks, and detents in the holder, and further wherein, upon rotation of the latch key together with the handle portion, the arms traverse along the respective arcuate tracks, and frictionally traverse over the friction surfaces to provide a tactile feel prior to registration of the arms in respective detents.

10. A latch key mechanism as recited in claim 7, and further comprising: a cam surface on the holder extending along a helical path encircling the latch key, a thrust bearing connected to the latch key, and upon rotation of the latch key and the thrust bearing relative to the holder, the thrust bearing traversing along the helical path to helically advance the latch key to said latching position.

11. A latch key mechanism as recited in claim 10, and further comprising: the thrust bearing having rollers, the rollers being urged by rotation of the latch key to traverse along the helical path.

12. A latch key mechanism as recited in claim 10, and further comprising: the thrust bearing having rollers, the rollers being urged by rotation of the latch key to traverse along the helical path, and the helical path being concave to conform to the rollers.

13. A latch key mechanism comprising:

a rotatable latch key having a profile for alignment with a profile of a keyhole into which the latch key is to be inserted, a latch portion on the latch key having the profile for alignment with the profile of the keyhole, a holder rotatably receiving the latch key, a spring connected to the latch key and to the holder, the spring biasing the latch key for rotation of the latch key to a desired position relative to the holder, at which desired position the profile for alignment with the profile of the keyhole is aligned relative to a portion of the holder that is known to be aligned with the profile of the keyhole prior to insertion of the latch key into the keyhole, and the latch key and the latch portion having been inserted into the keyhole, thereafter the latch key being rotatable against a resilient bias provided by the spring to rotate the latch key, and to rotate the latch portion to a latching position behind the keyhole following insertion of the profile into and beyond the keyhole.

14. A latch key mechanism as recited in claim 7, and further comprising: a thrust bearing connected to the handle portion, the thrust bearing having spaced apart walls, the latch key being connected to the thrust bearing by a transverse bar on the latch key that is between the spaced apart walls, the thrust bearing being rotatable with the handle portion without being accompanied by rotation of the latch key until the walls become engaged with the transverse bar, and the handle portion being further rotatable with the walls engaged against the transverse bar to urge the transverse bar to rotate the latch key together with the handle portion and together with the thrust bearing.

15. A latch key mechanism as recited in claim 14, and further comprising: a cam surface on the holder extending along a helical path, and upon rotation of the latch key together with the handle portion and together with the thrust bearing, the thrust bearing traverses the helical path to helically advance the latch key to said latching position.

* * * * *